US005827156A

United States Patent [19]

Barrett

[11] Patent Number: 5,827,156

[45] Date of Patent: Oct. 27, 1998

[54] UNIVERSAL EXERCISE SYSTEM

[76] Inventor: John Barrett, 3 Leo La., Naugatuck, Conn. 06770

[21] Appl. No.: 589,919

[22] Filed: Jan. 23, 1996

[51] Int. Cl.[6] ..... A63B 21/075

[52] U.S. Cl. ..... 482/93; 482/908

[58] Field of Search ..... 482/93, 94, 98, 482/97, 106–109, 148, 908

[56] References Cited

U.S. PATENT DOCUMENTS

| | | | |
|---|---|---|---|
| 4,801,137 | 1/1989 | Douglass . | |
| 5,137,502 | 8/1992 | Anastasi | 482/93 |
| 5,286,244 | 2/1994 | Wright et al. | 482/108 |
| 5,292,295 | 3/1994 | Gerlach | 482/77 |
| 5,310,393 | 5/1994 | Highsmith et al. | 482/93 |
| 5,312,314 | 5/1994 | Stephan et al. | 482/110 |
| 5,316,531 | 5/1994 | Spence | 482/93 |
| 5,332,119 | 7/1994 | Davis | 222/78 |
| 5,342,268 | 8/1994 | Caruthers | 482/108 |
| 5,540,640 | 7/1996 | Povilaitis | 482/106 |

*Primary Examiner*—Richard J. Apley
*Assistant Examiner*—John Mulcahy
*Attorney, Agent, or Firm*—Our Pal(R) Asija

[57] ABSTRACT

This invention relates to methods, devices and systems for exercise. An embodiment of this invention comprises a circular exercise wheel in the shape of a conventional automobile steering wheel with a weight attached along its diameter with a pair of wing nuts. The wing-nuts and bolts are attached such that they cannot be lost or stolen or misplaced.

10 Claims, 3 Drawing Sheets

UNIVERSAL EXERCISE SYSTEM

RELATED DOCUMENT

This invention is based on the concept disclosed and filed under USPTO Disclosure Document Program which was assigned document number 371,660 on Mar. 7, 1995.

BACKGROUND

This invention relates to exercise devices, methods and system. More particularly it relates to an exercise device that is universal in nature to provide exercise for various parts of the body and is useable anywhere and everywhere.

THE PROBLEM

The problem with prior art exercise devices is that they are not suitable for comprehensive work-out at home. They either take too much space or do not provide full range of exercise a human body needs for proper functioning.

SUMMARY

An embodiment of this invention comprises a circular exercise wheel in the shape of a conventional automobile steering wheel with means for quickly attaching and detaching different weights along its diameter with wing nut. The wing-nut and bolt are attached such that they cannot be lost or stolen or misplaced. Other embodiments are in the shape of star, triangle, diamond, square and rectangle etc. with similarly capability to add and decrease weight.

PRIOR ART

A preliminary prior art search has been conducted and furthermore the inventor is intimately familiar with the prior art. Following are typical examples of the prior art known to the inventor or his attorney arranged in the reverse chronological order for ready reference of the examiner and the reader.

a) U.S. Pat. No. 5,342,268 granted to Scott Cruthers on Aug. 30, 1994 for Exercise Devices.

b) U.S. Pat. No. 5,332,119 awarded to Richard Davis on Jul. 26, 1994 for "Personal Defense Apparatus and Combined Exercise Weight"

c) U.S. Pat. No. 5,316,531 earned by Wayman Spence on May 31, 1994 for "Hand Held Weighted Devices for Aerobic Exercise"

d) U.S. Pat. No. 5,312,314 conferred upon Stephan et al. on May 17, 1994 for "Exercise Yoke"

e) U.S. Pat. No. 5,310,393 honorably given to Highsmith et al on May 10, 1994 for "T-Bar Row Exercise Device"

f) U.S. Pat. No. 5,292,295 showered upon Michael Gerlach on Mar. 8, 1994 for "Exercise Hoop"

g) U.S. Pat. No. 5,286,244 issued to Wright et al on Feb. 15, 1994 for "Multi-Functional Hand Weight"

h) U.S. Pat. No. 4,801,137 awarded to Shane Douglass on Jan. 31, 1989 for "Variable Weight Hand Held Exercise Apparatus"

Unfortunately none of the prior art devices singly or even in combination meet all of the objectives established by the inventor for this Universal Exercise system as follows.

OBJECTIVES

1. It is an objective of this invention to provide a simple low cost exercise device.

2. Another objective of this invention is that it can be used to exercise various parts of the body.

3. Another objective of this invention is that its weight can be quickly and easily increased and decreased.

4. Another objective of this invention is that it is compact and easy to store.

5. Another objective of this invention is that it be safe stable and reliable.

6. Another objective of this invention is that it be ergonomically designed, environmentally friendly and aesthetically integrated.

7. Another objective of this invention is that it can be used at home, office or in transit with equal ease and facility.

8. Another objective of this system is that the user cannot accidentally destroy or even damage it.

9. Another objective of this invention is that it provides versatility and variety.

10. Another objective of this invention is that its various components are so attached that they cannot be misplaced or lost.

11. Another objective of this invention is that it can be made from a variety of materials.

12. Another objective of this invention is that it meet all federal, state, local and other private standards and regulations with respect to safety, environment, energy consumption, noise etc. etc.

13. Another objective of this invention is that it uses little or no energy.

14. Another objective of this invention is that it not interfere with normal bodily functions of the user.

15. Another objective of this invention is that it be adaptable for other primary and secondary uses without significant modifications.

16. Another objective of this invention is that it can be adapted for used by physically and mentally challenged users.

17. Another objective of this invention is that it provide a full range of exercises including, sittings, chest and limb exercises.

18. Another objective of this invention is that users obtain a firmer, quicker and faster body.

Other objectives of this invention reside in its simplicity, elegance of design, ease of manufacture, service and use and even aesthetics as will become apparent from the following brief description of the drawing and detailed description of the concept.

BRIEF DESCRIPTION OF THE DRAWING

The objects, features and advantages of the present invention and its application will be more readily appreciated when read in conjunction with the accompanying drawings, in which.

a)

b)

c)

d)

e)

f)

g)

h)

DETAILED DESCRIPTION OF THE BEST MODE EMBODIMENT

Figure 1:
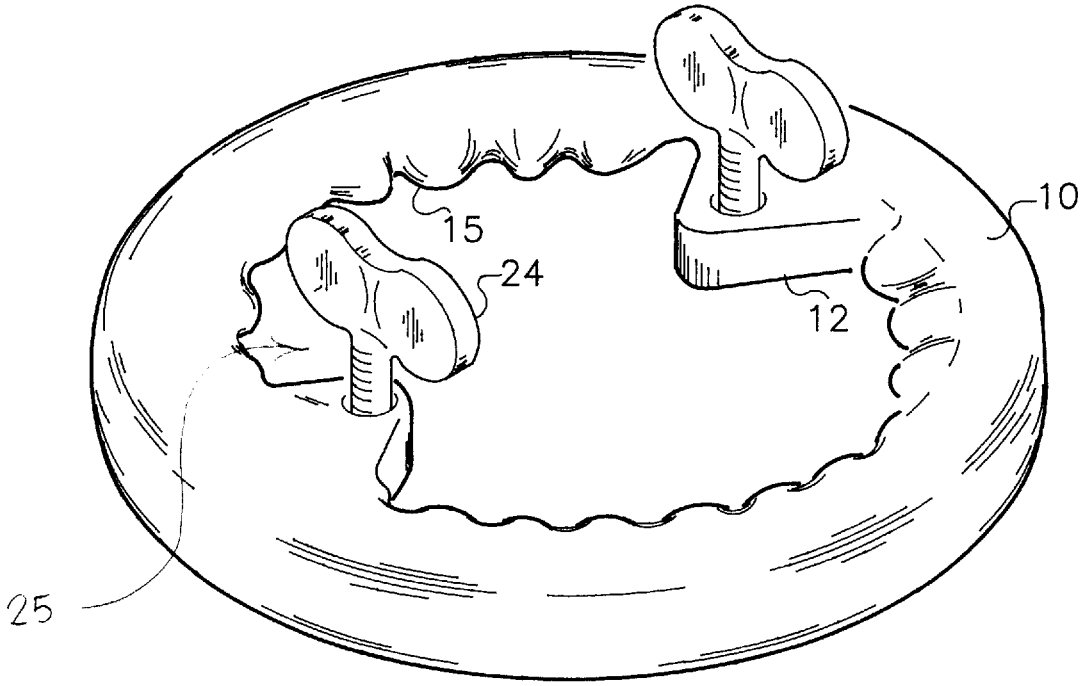
FIG. 1 is an isometric perspective view of the preferred embodiment of this invention without the center weight bar.
Figure 2:
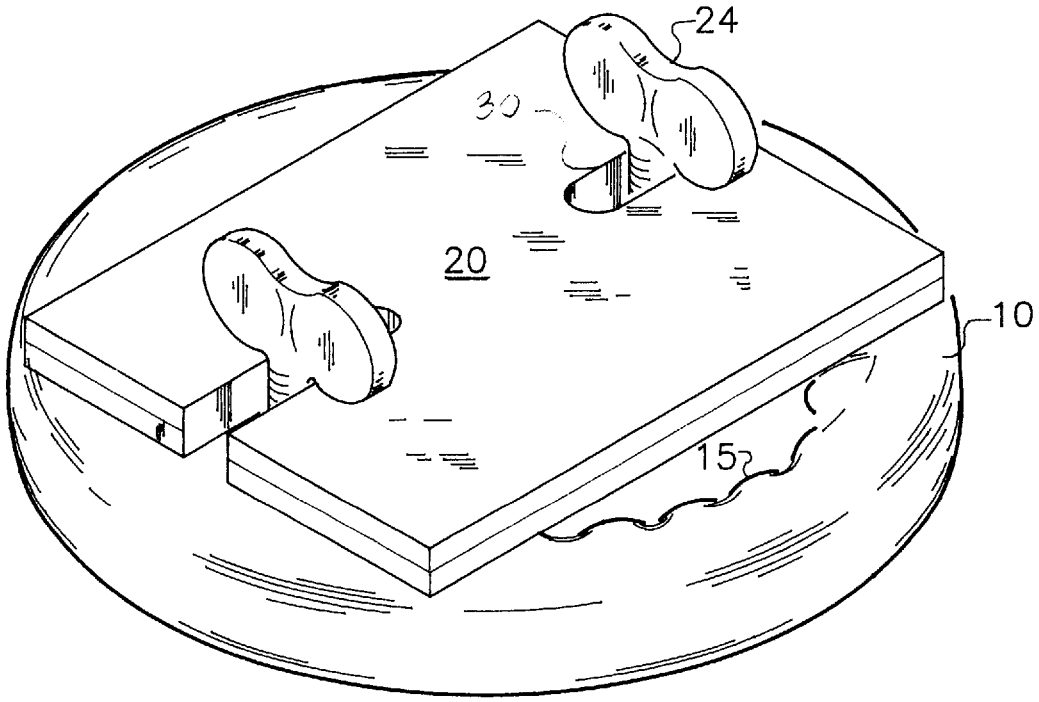
FIG. 2 shows the isometric perspective view of this invention with center weight bar.
Figure 3:
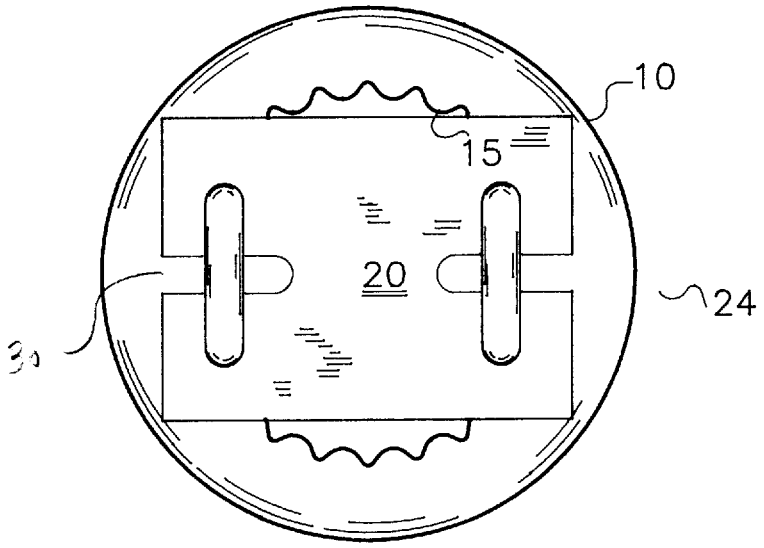
FIG. 3 shows top plan view thereof.
Figure 4:
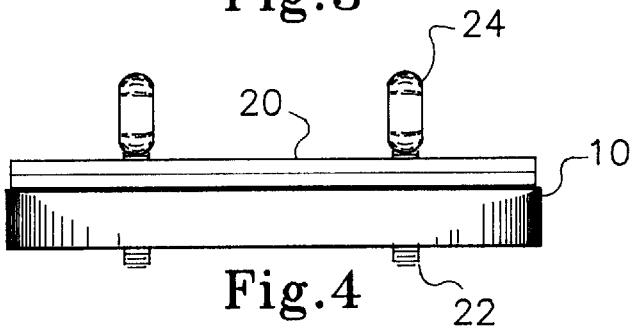
FIG. 4 shows side elevation thereof.
Figure 5:
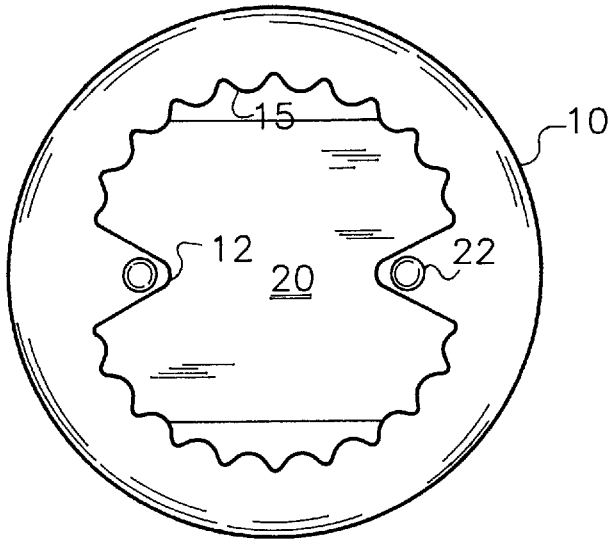
FIG. 5 shows back plan view thereof.
Figure 6:
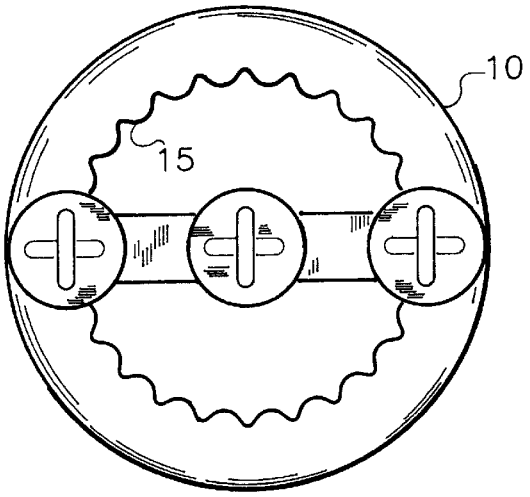
FIG. 6 shows top plan view of first alternate embodiment.

As shown in the drawings wherein like numerals represent like parts throughout the several views, there is generally disclosed a heavy stand alone steering wheel 10 with means 25 for quickly attaching and detaching different weights 20 along its diameter as a horizontal transverse member.

The inner circumference of the steering wheel 10 has smooth ridges 15 for comfortably and firmly holding the steering wheel by two hands on opposite points of the exercise steering wheel. To provide extra support for the weight 20 the steering wheel has v shaped inward projections 12.

One simple means for attaching and detaching weights 20 is to use wing nuts 25 having a screw 22 and wing nut 24. To obviate loosing the wing nut, it is attached to the bolt in such a way that it does not come off the screw completely. A slot 30 is provided in the weight to facilitate changing the weight without removing the wing nut from the screw but aligning the wing nut 24 with the slot in the transverse member provided for this purpose.

Figure 7:
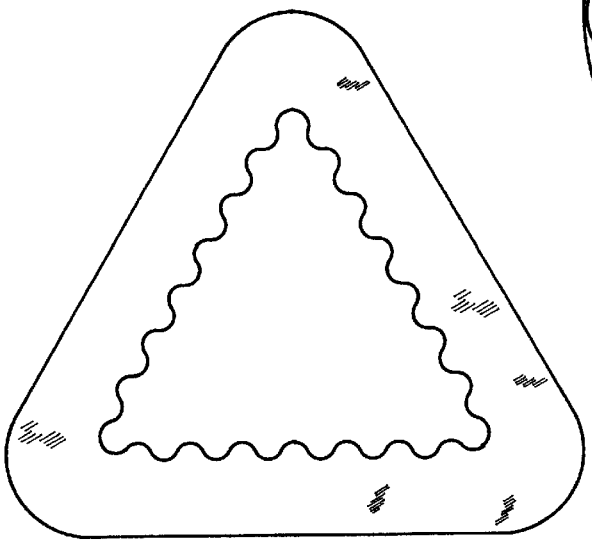
FIG. 7 shows top plan view of second alternate embodiment.
Figure 8:
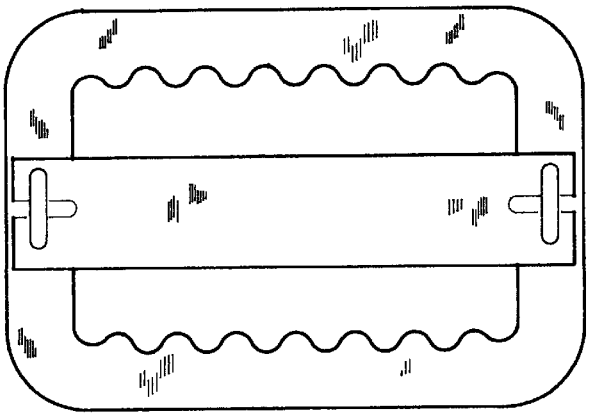
FIG. 8 shows top plan view of yet another alternate embodiment.

While the preferred embodiment is circular, other embodiments inter alia star, triangle (Fig.7) rectangle (Fig.8) and square shapes are just as practical.

OPERATION

The use and the operation of this invention is very simple and even intuitive. The device is used by holding the steering wheel at two opposite points and performing various exercises in a variety of ways to strengthen different parts of the body. As the user gets used to a certain weight level the weights are progressively increased. The same device can be used by all members of the family as the weight can be adjusted down for a child or up for an adult.

The inventor has given a non-limiting description of the concept. Many changes may be made to this design without deviating from the spirit of the concept of this invention. Examples of such contemplated variations include the following.

a) The invention may be combined with other functions which complement each other with or without synergism.

b) Sizes, shapes aesthetics of the personal universal exercise system may be modified.

b) The device may be adapted for other related uses.

c) The device may be made from different materials.

d) Advertisements of sponsor may be incorporated into the device.

e) Additional fool proof safety measures may be added.

f) Additional exercise protocols may be developed for use with any of the embodiments disclosed.

g) Additional embodiments may be added.

Other changes such as aesthetic and substitution of newer materials as they become available which substantially perform the same function in substantially the same way with substantially the same result without deviating from the spirit of this invention may be made.

Following is a listing of the components used in this embodiment arranged in ascending order of the reference numerals for ready reference of the reader.

10=Steering wheel shaped exercise wheel.

12=V shaped inward projections on steering wheel to provide extra support for the diametric weight and to compensate for the loss of strength therein due to hole therein.

15=Ridges along inside circumference of steering wheel shaped exercise wheel

20=Weight along the diameter of the exercise wheel

22=Bolt or screw for receiving wing nut

24=wing nut

25=Means for attaching and detaching weights generally

30=Slot in the weight

While this invention has been described with reference to illustrative embodiments, this description is not intended to be construed in a limiting sense. Various modifications and combinations of the illustrative embodiments as well as other embodiments of the invention will be apparent to persons skilled in the art upon reference to this description. It is therefore contemplated that the appended claims cover any such modifications, and/or embodiments that fall within the true scope of the invention.

The inventor claims:

1. A universal exercise device comprising:

a) a handle member comprising an open frame defining a pair of hand grips on opposite sides thereof for gripping with both hands;

b) a pair of threaded fasteners operatively connected to the open frame on opposite sides thereof for connecting a weight bar transversely across the open frame between the hand grips; and c) a weight bar having a pair of open-ended slots at opposite ends thereof for engaging a respective one of the threaded fasteners such that the weight bar may be connected and disconnected from the handle member without separating the threaded fasteners completely from the open frame.

2. The universal exercise device of claim 1, wherein the open frame is circular or triangular or rectangular or square.

3. The universal exercise device of claim 1, wherein the weight bar is rectangular.

4. The universal exercise device of claim 3, wherein the open frame is circular or triangular or rectangular or square.

5. The universal exercise device of claim 1, wherein the hand grips include means for providing a firm hold.

6. The universal exercise device of claim 5, wherein the means for providing a firm hold comprises ridges on the hand grips.

7. The universal exercise device of claim 6, wherein the ridges are formed on an inner perimeter of the open frame.

8. The universal exercise device of claim 1, wherein the threaded fasteners are wing nuts.

9. The universal exercise device of claim 8, wherein the open frame is circular or triangular or rectangular or square.

10. The universal exercise device of claim 1, wherein the threaded fasteners are operatively connected to inward projections of the open frame.

* * * * *